United States Patent [19]

Stevens

[11] 4,409,070

[45] Oct. 11, 1983

[54] METHOD OF FORMING ARTICLES BY PLATING

[75] Inventor: James W. Stevens, Hatfield, England

[73] Assignee: British Aerospace Public Limited Company, London, England

[21] Appl. No.: 376,139

[22] Filed: May 7, 1982

[30] Foreign Application Priority Data

May 8, 1981 [GB] United Kingdom ..... 81114/63

[51] Int. Cl.[3] ..... C25D 1/00; C25D 1/20

[52] U.S. Cl. ..... 204/4

[58] Field of Search ..... 204/3, 4, 12, 281

[56] References Cited

U.S. PATENT DOCUMENTS 4,314,892 2/1982 Stevens ..... 204/38 B

FOREIGN PATENT DOCUMENTS 600854 6/1960 Canada ..... 204/4

2039526A 12/1979 United Kingdom ..... 204/4

*Primary Examiner*—T. M. Tufariello

*Attorney, Agent, or Firm*—Cushman, Darby & Cushman

[57] ABSTRACT

A method of forming an article having a rough surface for being adhesively bonded to a further member includes pressing a discontinuously surfaced layer 12 of electrically conducting material (for example copper powder) onto the surface of an electrically conducting substrate 11 (for example uncured synthetic rubber loaded with carbon black), so that portions of the layer 12 are embedded in the surface. The exposed parts of the layer 12 are then electro-plated with a metal and the substrate is then removed to provide said formed article.

12 Claims, 2 Drawing Figures

METHOD OF FORMING ARTICLES BY PLATING

This invention relates to a method of forming metallic articles having a rough or discontinuously surfaced region adapted to key to a bonding agent.

When bonding an article to another article, by means of an adhesive, the strength of the bond is increased if the surfaces to which the adhesive is applied are roughened to assist keying of the adhesive.

According to one aspect of this invention, there is provided a method of forming an article having a rough surface for being adhesively bonded to a further member which method comprises the steps of (i) pressing a discontinuously surfaced layer of electrically conducting material onto the surface of an electrically conducting substrate so that portions thereof are embedded in said surface, (ii) electroplating the exposed parts of said layer of electrically conducting material with a metal, and (iii) releasing the substrate from the formed article, the portions of the discontinuously surfaced layer which formerly were embedded in the substrate serving to define a roughened, adhesive receptive layer.

The substrate may be of an elastically deformable material and preferably is formed of a curable elastomeric material, the layer of electrically conducting material being pressed into the surface of the substrate when in its uncured state, the substrate subsequently being at least partially cured prior to electroplating.

The discontinuously surfaced layer conveniently comprises a coating of metal particles, for example copper powder.

Alternatively, the discontinuously surfaced layer may comprise a perforated metal lamina, a metal gauze or a carbon cloth.

Where the discontinuously surfaced layer comprises a coating of metal particles, the coating of metal particles is advantageously pressed onto the surface of the substrate using a pressing member which leaves the layer with a smooth, shiny layer.

The substrate may be in the form of a re-usable tool which after release from a formed article may be employed in the form of further articles.

The conducting material may be applied to the substrate in a predetermined pattern, thereby to form a correspondingly shaped article.

The electroplating used may include applying a flash-plating of copper over said layer and then nickel-plating over said flash-plating.

The invention also extends to an article when formed according to the method described.

Figure 1:
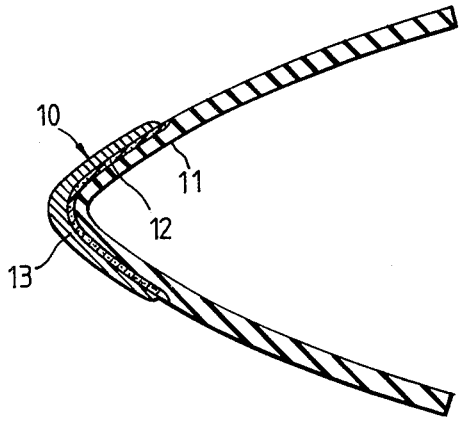
Figure 2:
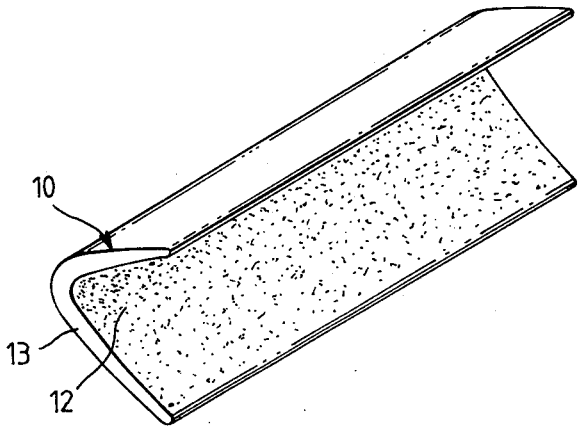

For a better understanding of the invention and to show how the same may be put into effect, reference will now be made, by way of example, to the accompanying drawings, in which:

FIG. 1 is a section view through a formed article prior to release from a substrate, and FIG. 2 is a perspective view of a finished article after release from a substrate.

Referring to the Figures, there is shown a metallic article 10 of generally V-shaped form. The article 10 is made by taking a suitably shaped substrate 11 of uncured or partially cured synthetic rubber which has been made electrically conductive by the inclusion in its composition of a conductive filler material, such as carbon black, and applying to a surface of the substrate a coating 12 of copper powder. Instead of synthetic rubber, natural rubber or a rubber-like material, such as plasticized resin, may be used for the substrate 11. A coating of copper powder is then pressed into the surface of the strip whilst heating the strip to cure it. Particles of copper thus become embedded in the surface or the substrate 11 and bonded thereto. The cured strip is then electroplated in a known manner with nickel 13 over the copper powder coating. Prior to the nickel plating, a flash-plate of copper (not shown) may be applied to the copper powder coating.

When a coating of sufficient thickness has been plated on to the substrate, the electroplating process is stopped. The rubber or rubber-like substrate 11 is then removed from the formed article 10. Naturally, the thickness of the plating must be sufficient to allow removal of the substrate without excessive deformation of the finished article.

The portions of the coating 12 of copper powder which are embedded in the surface of the substrate 11 will be isolated from the electro-plating step, whilst those portions exposed to the electro-plating step will form the base for growth of the plate. Thus, on release of the formed article 10 from the substrate 11, the surface of the article adjacent that of the substrate will be rough, due to those portions of the coating texture of the copper powder which are not electro-plated. Moreover, since the surface adjacent the substrate has been sealed from the electro-plating process, the surface will be relatively clean, thus obviating any need for de-oxidising or degreasing. The roughened surface is therefore particularly suitable for being adhesively bonded to another member.

Instead of a coating of copper powder, there could be applied to the surface of the uncured rubber strip fine copper gauze, the gauze being pressed into the surface of the rubber substrate 11 while the substrate is cured and the nickel-plating 13 then applied as before with or without an initial flash plate of copper. Instead of gauze, carbon cloth or a perforated metal lamina might be used or any other kind of layer of electrically conductive material having a suitable texture such that portions of the material can protrude into the surface of the uncured rubber and hence become bonded thereto during the curing process.

It is found that the texture of the initial coating on the rubber substrate can be evident in the surface texture of the plated article. Thus, where an even coating of copper powder is used, the texture of the finished article is substantially continuous and smooth. However, where a carbon cloth is used, the texture of the finished article may include traces of the texture of the carbon cloth, depending on the thickness of the plating. Thus, the form of the initial layer should be selected having regard to the inherent strength and surface texture required for the particular application.

It is preferred that a solvent such as Naptha is applied to the rubber surface before or with the copper powder so as to make the surface tacky and hence more likely to retain a uniform coating of the powder. However, depending upon the particular materials used, it may be sufficient to rely on the natural surface attraction between the rubber and the copper powder to give this uniform coating. A release film (not shown) may be laid over the substrate 11, after it has been coated with the copper powder, and fixed in place, for example, with adhesive tape. The release film is such that it will not stick to the copper powder and will help to produce a shiny surface to the copper powder layer after this has been pressed into the rubber, thereby to assist the plating. The film may comprise Capron for example.

In some applications, where there is a reasonable tolerance allowable in the dimensions of the finished article, after one article 10 has been formed and the substrate 11 has been released therefrom, the substrate 11 may be used to form a further article. In this case, the rubber substrate 11 is preferably only partially cured after application of the metal powder.

After forming, the article may be bonded to a further surface by means of a suitable adhesive such as a thermosetting resin. Articles made by means of this method may be used for applications where surface protection is important, for example, as protection surfaces for boat hulls etc.

Naturally, other shapes and sizes of substrate may be used to form articles in shapes different to that illustrated. For example, a heating element for a deicing panel could be formed by applying the coating of copper powder in a predetermined pattern.

I claim:

1. A method of forming an article having a rough surface for being adhesively bonded to a further member which method comprises the steps of (i) applying a discontinuously surfaced layer of electrically conducting material to the surface of a substrate of electrically conducting curable elastomeric material, (ii) pressing said layer onto said surface of the substrate so that portions thereof are embedded in said surface, (iii) electroplating the exposed parts of said layer with a metal, and (iv) releasing the substrate from the formed article, the portions of the discontinuously surfaced layer which formerly were embedded in the substrate serving to define a roughened adhesive-receptive surface.

2. A method according to claim 1, wherein the layer of electrically conducting material is pressed into the surface of the substrate when in its uncured state, the substrate subsequently being at least partially cured prior to electroplating.

3. A method according to claim 1 or 2, wherein said discontinuously surfaced layer comprises a coating of metal particles.

4. A method according to claim 3, wherein the metal particles are copper powder.

5. A method according to claim 1 or 2, wherein said discontinuously surfaced layer comprises a perforated metal lamina.

6. A method according to claim 1 or 2, wherein said discontinuously surfaced layer comprises a metal gauze.

7. A method according to claim 1 or 2, wherein said discontinuously surfaced layer comprises a carbon cloth.

8. A method according to claim 1, wherein the discontinuously surfaced layer is pressed onto the surface of the substrate using a pressing member which leaves the layer with a smooth, shiny layer.

9. A method according to claim 1, wherein the substrate is in the form of a re-usable tool which after release from a formed article may be employed in the forming of further articles.

10. A method according to claim 1, wherein the conducting material is applied to the substrate in a predetermined pattern, thereby to form a correspondingly shaped article.

11. A method according to claim 1, wherein the electro-plating includes applying a flash-plating of copper over said layer and then nickel-plating over said flash-plating.

12. A metal article having a roughened adhesive receptive layer for being adhesively bonded to a further member, said article being made by applying a discontinuously surfaced layer of electrically conducting material to the surface of a substrate of electrically conducting curable elastomeric material, pressing said layer onto said surface of the substrate so that portions thereof are embedded in said surface, electroplating the exposed parts of said layer with a metal and releasing the substrate from the formed article, the portions of the discontinuously surfaced layer which were formerly embedded in the substrate serving to define a roughened adhesive receptive surface.

* * * * *